United States Patent [19]

Clift

[11] Patent Number: 4,761,248

[45] Date of Patent: Aug. 2, 1988

[54] PROCESS FOR PREPARING PARTICULATE DETERGENT PRODUCTS

[75] Inventor: V. Stanley Clift, Trona, Calif.

[73] Assignee: Kerr-McGee Chemical Corporation, Oklahoma City, Okla.

[21] Appl. No.: 927,545

[22] Filed: Nov. 6, 1986

[51] Int. Cl.[4] ..... C11D 3/066; C11D 3/07

[52] U.S. Cl. ..... 252/527; 252/135; 252/174.14; 264/117; 23/313 R; 23/313 AS

[58] Field of Search ..... 252/527, 174.14; 264/117; 23/313 R, 313 AS

[56] References Cited

U.S. PATENT DOCUMENTS

| | | | |
|---|---|---|---|
| 3,368,978 | 2/1968 | Irani | 252/526 |
| 3,585,146 | 6/1971 | Shen | 252/137 |
| 3,597,361 | 8/1971 | Summer | 252/558 |
| 3,639,289 | 2/1972 | Heymer et al. | 252/110 |
| 3,684,744 | 8/1972 | Shen | 252/546 |
| 4,427,417 | 1/1984 | Pornsik | 252/313 |

*Primary Examiner*—Paul Lieberman
*Assistant Examiner*—John F. McNally
*Attorney, Agent, or Firm*—William G. Addison; John P. Ward

[57] ABSTRACT

A process for producing agglomerated substantially completely hydrated detergent products is disclosed. The process includes forming an admixture containing, in combination, a hydratable condensed phosphate component, a hydratable detergent builder salt component, an alkali metal silicate and water, said water being present in an amount sufficient to effect agglomeration of the admixture and induce hydration of the hydratable components therein. A hardness sequestering agent then is added to the agglomerated and hydrated admixture and the resulting intermediate product subjected to aging to provide the finished agglomerated, substantially completely hydrated detergent product.

5 Claims, No Drawings

PROCESS FOR PREPARING PARTICULATE DETERGENT PRODUCTS

FIELD OF THE INVENTION

This invention relates to an agglomeration process for producing particulate, substantially hydrated detergent products. More particularly, this invention relates to a single-stage agglomeration process wherein formulated admixtures of detergent-forming components are prepared, agglomerated and substantially completely hydrated to produce dry, pourable, particulate detergent products. The detergent products produced by this invention are characterized by their resistance to caking during storage at ambient temperatures.

BACKGROUND OF THE INVENTION

There exists a voluminous body of both patent and nonpatent literature describing agglomeration processes for producing a wide variety of dry, pourable, particulate detergent products whose formulations are based, in the main, on particulate hydratable detergent salts. Although these agglomeration processes may vary procedurally, one from the other, one step common to all is a liquid-solid blending step to effect agglomeration of all the solid components in the detergent formulation and to induce hydration of the hydratable detergent salts present therein.

A major objective of detergent manufacturers is the production of detergent products which are characterized by good storage stability, i.e., are resistant to caking, at ambient temperatures. Thus, a second step common to all agglomeration processes is the aging of the agglomerated and hydrated detergent formulations. This aging is carried out under relatively mild temperature conditions and for a period of time sufficient to remove excess free (or nonbound) water and to convert the hydratable detergent salts in the detergent formulation to their stable hydrates.

While the above generally described agglomeration processes work well for preparing most detergent products based on detergent formulations containing hydratable detergent salts, it has been observed that these processes do not work well on detergent formulations which also contain certain commonly employed hardness sequestering agents. Particularly, it has been observed that when hardness sequestering agents such as alkali metal salts of aminopolycarboxylic acids are incorporated into detergent formulations containing hydratable detergent salts and this formulation subsequently agglomerated and aged, the resulting particulate detergent product obtained lacks the requisite storage stability required of present day detergent products.

The present invention is based upon the surprising discovery of a new process which provides for the agglomeration of particulate, substantially hydrated detergent products from detergent formulations incorporating alkali metal salts of aminopolycarboxylic acids which detergent products are characterized by their excellent storage stability.

SUMMARY OF THE INVENTION

Broadly, the present invention comprises a single-stage agglomeration process for producing agglomerated, substantially completely hydrated detergent products containing a hardness sequestering agent selected from the group consisting of alkali metal salts of aminopolycarboxylic acids.

More particularly, this process comprises first forming, in an agglomeration zone, an admixture containing in combination at least one hydratable anhydrous condensed phosphate component, at least one hydratable, anhydrous detergent builder salt component, a water soluble alkali metal silicate and water. The water, which forms a part of the admixture, is present in the admixture in an amount sufficient to wet the remaining components of the admixture, to effect agglomeration of the admixture and to induce hydration of the hydratable anhydrous condensed phosphate and detergent builder salt components therein. Following inducement of hydration, the hardness sequestering agent is introduced into the admixture in the agglomeration zone. The resulting admixture is retained in the agglomeration zone until agglomeration of the admixture is completed. The agglomerated admixture then is aged at temperatures sufficient to remove excess free (or nonbound) water and to substantially complete hydration of the hydratable anhydrous condensed phosphate and detergent builder salt components and any other hydratable compounds incorporated in the admixture.

DETAILED DESCRIPTION OF THE INVENTION

It now has been discovered that particulate detergent products produced from detergent formulations or admixtures based on hydratable anhydrous condensed phosphate and detergent builder salt components, including as a hardness sequestering agent an alkali metal salt of an aminopolycarboxylic acid, can be prepared by a single-stage agglomeration process wherein the hydratable anhydrous condensed phosphate and detergent builder salt components are substantially completely hydrated.

The essence of the invention resides in the particular sequence in which the aforementioned hardness sequestering agent is blended with the hydratable anhydrous condensed phosphate and detergent builder salt components in the detergent formulation or admixture. Particularly, it has been found that in order to obtain substantially complete hydration of these hydratable anhydrous components and any other hydratable components in the detergent formulation or admixture, it is necessary to incorporate the hardness sequestering agent into this formulation or admixture subsequent to induction of agglomeration of the admixture and induction of hydration of the hydratable anhydrous components therein. Incorporation of the hardness sequestering agent prior to induction of agglomeration and hydration of the hydratable anhydrous components can lead to finished detergent products that may not be suitably stable on storage, i.e., may tend to cake or form hard, lumpy products. Although not desiring to be bound by any theoretical considerations, it is believed that these hardness sequestering agents inhibit, in varying degrees, the extent of hydration of the hydratable anhydrous components in the admixture. This, in turn, would result in the presence in the admixture of concomitant varying degrees of excess free (or nonbound) water. Thus, it would be this excess free (or nonbound) water in the admixture which would be the cause of any subsequent storage problems associated with the finished detergent products.

As noted hereinabove, the method constituting this invention is a single-stage agglomeration process. By the term "single-stage agglomeration process", as employed throughout this specification and appended claims, is meant a process wherein there is essentially only one agglomeration step and wherein no ingredients, except possibly chlorine releasing agents, dyes, perfumes, and the like, are added subsequent to agglomeration. While the method of this invention can include mixing and blending steps both prior and subsequent to the single agglomeration step, such steps will not be of a nature to cause any significant agglomeration.

While the use of the present invention is illustrated hereinbelow on a batch basis, it also can be practiced in a semi-continuous or continuous operation. The apparatus, i.e., the agglomerator, dryer, conveying equipment, and the like, employed in the implementation of this invention also will consist by and large of conventional, commercially available components. For example, as representative of the types of agglomerators that can be utilized in practicing this invention, there may be mentioned the various rotating mixers, equipped with spray nozzles or liquid dispersion bars. These may be of the drum-type such as illustrated in U. S. Pat. No. 3,597,361 or of the cone-type such as the Patterson-Kelley V-shaped twin shell and zigzag-type blenders. Any of the various dryers currently employed for drying and aging agglomerates also may be employed in the operation of this invention including fluid bed dryers such as illustrated in U. S. Pat. No. 4,427,417 and rotating drum dryers such as the "Roto-Louvre" dryer available from the Link-Belt Division of FMC Corporation.

As mentioned hereinabove, the essence of the method constituting this invention resides in the particular sequence of steps in which the various components in the detergent formulation or admixture are blended. Accordingly, the method comprises first forming, in an agglomeration zone, an admixture containing, in combination, at least one hydratable anhydrous condensed phosphate component, at least one hydratable anhydrous detergent builder salt component, at least one alkali metal silicate and water. The hydratable anhydrous condensed phosphates that can be employed in forming the admixture in the agglomeration zone can include any of the alkali metal condensed phosphate salts well known to those engaged in the detergent industry. Typical alkali metal condensed phosphate salts employed in the detergent industry and useful in the method of this invention include, for example, tetrasodium pyrophosphate, tetrapotassium pyrophosphate, sodium tripolyphosphate, other alkali metal polyphosphates, and the like. Mixtures of these salts also can be employed. These salts, as introduced into the agglomeration zone, will contain less than about 0.5 percent by weight of water and, for the purposes of this invention, are considered to be substantially anhydrous.

The hydratable anhydrous detergent builder salts employed in forming the admixture in the agglomeration zone also can include any of those well known and frequently utilized in the detergent industry. Representative, but nonlimiting, examples of these detergent builder salts are the alkali metal carbonates, sulfates, pyrophosphates and metaborates, and the water soluble lower fatty acids of these alkali metals. Preferred detergent builder salts are typically sodium carbonate, sodium bicarbonate, potassium carbonate, and the like.

The alkali metal silicates suitable for use in the method of this invention can be introduced into the agglomeration zone either in dry form or they can be added as aqueous solutions. When added in dry form, the independent addition of water to effect agglomeration and hydration of the hydratable anhydrous components, i.e., the anhydrous condensed phosphate, the anhydrous detergent builder salt and any other hydratable anhydrous components in the admixture, will be required. When added as aqueous solutions, the water in the aqueous solution will serve to wet the admixture and to provide at least a portion, if not all, of the water required to effect the desired agglomeration and hydration. Preferably, the alkali metal silicate is introduced into the agglomeration zone as an aqueous solution. Useful solutions are those containing alkali metal silicate contents ranging from about 35 to about 50 percent by weight and wherein the silicate/alkali metal oxide ratios of the alkali metal silicate dissolved therein range from about 1.6:1 to about 3.22:1. Particularly useful alkali metal silicates most widely used in various detergent products are the sodium silicates having $SO_2$/-$Na_2O$ ratios within the above disclosed ranges.

Subsequent to the introduction of the alkali metal silicate into the agglomeration zone and the onset of agglomeration and hydration of the admixture, a hardness sequestering agent selected from the group consisting of alkali metal salts of aminopolycarboxylic acids then is introduced into the admixture. This hardness sequestering agent can be added to the admixture either in dry form, i.e., as a particulate solid, or as an aqueous solution. Generally, however, it will be added in the form of an aqueous solution containing, for example, from about 50 to about 52 percent by weight of the hardness sequestering agent. Representative examples of these hardness sequestering agents are the sodium and potassium salts of polyamine acids such as N-hydroxyethylimiodiacetic acid, nitrilotriacetic acid, N-hydroxyethyl-N,N',N'-ethylinediaminetriacetic N,N,N',N'-ethylinediaminetetracetic acid, and the like. A particularly useful hardness sequestering agent from this class of sequestering agents is trisodium nitrilotriacetate monohydrate ($N(CH_2CO_2Na)_3 \cdot H_2O$).

As mentioned hereinabove, the hardness sequestering agent is introduced into the agglomeration zone subsequent to the addition thereto of the alkali metal silicate and the onset of agglomeration and hydration of the admixture in said agglomeration zone. In the illustration which follows and which example utilized a batch process, the addition was made immediately following completion of the addition of the alkali metal silicate solution. In a semi-continuous or continuous process, the hardness sequestering agent can be introduced concurrently with the alkali metal silicate. However, even in such semi-continuous and continuous processes, the initial introduction of the hardness sequestering agent will be started only after the introduction of the alkali metal silicate has been commenced. Of critical importance in such semi-continuous and continuous processes is that agglomeration and hydration of the hydratable anhydrous components in the admixture in the agglomeration zone be commenced prior to any introduction of the hardness sequestering agent.

On completion of the introduction of the hardness sequestering agent into the agglomeration zone, an agglomerated intermediated product is obtained which is subjected to aging at temperatures sufficient to allow substantially complete hydration of the hydratable anhydrous components and to remove any excess free (or nonbound) water therein. In general, the temperature employed in this aging step will be a minimum temperature of at least the ambient temperature of the agglomerated intermediate product recovered from the agglomeration zone, said temperature resulting from the evolution of heat of hydration therein. Usually such minimum temperatures will range from about 38° to about 49° C. However, higher drying air temperatures, e.g., 95° C., and preferably 85° C. also can be employed for purposes of assuring the recovery of a finished detergent product containing less than about 3 percent by weight of free or nonbound water. To produce a finished detergent, air heated to said ambient or higher temperatures can be passed through the intermediate product while maintaining said intermediate product in a state of agitation. The final detergent product recovered, upon completion of this aging step is an agglomerated, substantially completely hydrated, detergent product characterized by its resistance to caking upon storage. The term "substantially completely hydrated" as used herein means a degree of hydration ranging from about 70 percent to 100 percent of the theoretical water of hydration for the particular detergent product produced.

In addition to the basic hydratable anhydrous condensed phosphates, detergent builder salts, alkali metal silicates and the hardness sequestering agents herein described, the detergent products capable of manufacture by the method of this invention further can include other known detergent ingredients. Representative examples of other known detergent ingredients include, broadly, surfactants (particularly nonionics), fillers (including neutral salts such as sodium sulfate and sodium chloride), alkali metal hydroxides, dyes, soil antiredeposition agents (such as carboxymethyl cellulose), perfumes, chlorine releasing agents, and the like.

The method of the present invention can be employed to produce a wide variety of detergent products utilizing alkali metal salts of aminopolycarboxylic acids as hardness sequestering agents. Such detergent products include laundry detergents as well as automatic dish washing detergents. The following example is illustrative of the use of the method of the present invention to prepare a typical laundry detergent and the extent of hydration which can be achieved therein.

EXAMPLE 1

A substantially completely hydrated detergent product is prepared in accordance with the method of this invention using an O'Brien batch-type rotary drum blender-agglomerator. This blender-agglomerator is equipped with an internal cylindrical bar cage spaced approximately 4 inches inwardly from the drum wall and a liquids introduction means positioned internal to the bar cage. In design and operation, the blender-agglomerator is similar to the blender-agglomerator apparatus illustrated in U.S. Pat. No. 3,597,361. The detergent product is prepared by combining, in the blender-agglomerator in the order and percentages indicated, the component materials set forth in the Table below.

TABLE

| Component | Order of Addition | Parts by Weight Solids | Water |
|---|---|---|---|
| Sodium tripolyphosphate | 1 | 4.49 | |
| Sodium carbonate | 1 | 35.95 | |
| Sodium chloride | 1 | 26.96 | |
| Ultramarine blue | 1 | 0.04 | |
| Carboxymethyl cellulose | 1 | 0.90 | |
| Perfume | 1 | 0.07 | |
| Brightener | 1 | 0.11 | |

TABLE-continued

| Component | Order of Addition | Parts by Weight Solids | Water |
|---|---|---|---|
| Water | 2 | | 7.10 |
| Aqueous sodium silicate | 3 | 7.24 | 8.49 |
| (46% solids; $Na_2O/Sio_2$ ratio 1:2.40) | 3 | 7.24 | 8.49 |
| Trisodium nitrilotriacetate (NTA) | 4 | 1.80 | |
| Nonionic surfactant | 5 | 6.86 | |
| | TOTALS | 84.41 | 15.59 |

The various component materials are charged to the blender-agglomerator apparatus in the order indicated. With regard to the sodium tripolyphosphate, sodium carbonate and sodium chloride, these are added to the apparatus in dry Vform at ambient temperatures, i.e., about 21° C.–27° C. Rotation of the apparatus is then begun and the speed thereof is adjusted to provide a uniform falling curtain of an admixture of these component materials. Once this uniform falling curtain is established, the remainder of the component materials are introduced through the introduction means and onto this falling curtain. While the aqueous sodium silicate components (heated to a temperature of about 54° C.) and water are introduced individually the remainder of the component materials, with the exception of the surfactant, are combined into a single additive mixture prior to being introduced into the blender-agglomerator apparatus.

The addition of all of the liquid components is completed in a period of between 5 and 10 minutes. The temperature of the admixture in the blender-agglomerator increases to between about 48° C. and 49° C. during this time as a result of the heat released by hydration of the sodium tripolyphosphate and sodium carbonate in the admixture.

Following completion of the addition of all of the liquid components the resulting agglomerated admixture is retained in the blender-agglomerator apparatus for an additional 20 minutes to effect aging of the admixture. Heated air is passed through the blender-agglomerator apparatus during this time to reduce the free water content of the agglomerated admixture. The detergent product recovered from the blenderagglomerator apparatus contains about 75.6 percent of the theoretical bound water calculated for this product.

COMPARATIVE EXAMPLE

A second detergent product is prepared in the same manner employing the same identical component materials, the same amounts of these materials and apparatus as employed in Example 1 above. In this Comparative Example, however, the sequence of addition of the trisodium nitrilotriacetate component and the aqueous sodium silicate component are reversed. The detergent product that is recovered from the blender-agglomerator apparatus upon completion of the process, unlike the detergent product of the Example above, is not substantially completely hydrated, but rather, contains only about 32.9 percent of the theoreretical bound water calculated for this product.

From a comparison of the extent of hydration of the detergent products prepared in the above Examples it can be seen that the detergent product prepared in accordance with the present invention exhibits a markedly superior degree of hydration over that of the detergent product prepared by the more conventional practice of incorporating the hardness sequestering agent into the detergent formulation prior to the onset of agglomeration and hydration of the formulation. Such comparison demonstrates that through the practice of this invention a degree of hydration of greater than two times that provided by the more conventional practice can be achieved. Furthermore, practice of the process of this invention permits detergent products incorporating these hardness sequestering agents to be produced in a single-phase agglomeration step. Such a capability avoids the need of using multi-phase agglomeration operations such as described in U.S. Pat. No. 4,427,417 and the increased costs of equipment, energy, handling, and the like, associated with such multiple operations.

It will be apparent to those skilled in the art that many changes, variations and modifications can be made to, and other uses and applications made of the invention specifically described herein. It is intended that all such changes, variations, modifications and other uses and applications are included within the spirit and scope of the following claims.

What is claimed is:

1. A single-stage agglomeration process for producing agglomerated, substantially completely hydrated detergent products containing trisodium nitrilotriacetate as a hardness sequestering agent comprising the steps in sequence of:

forming, in an agglomeration zone, an admixture containing in combination at least one hydratable anhydrous condensed phosphate component, selected from the group consisting essentially of alkali metal carbonates, sulfates, pyrophosphates and metorates, and the water soluble lower fatty acids of these alkali metals, at least one hydratable anhydrous detergent builder salt component, an alkali metal silicate and water, wherein said water is present in the admixture in an amount sufficient to wet the admixture and thereby effect an agglomeration of the admixture and to induce hydration of the hydratable anhydrous components therein;

introducing into the admixture formed in the agglomeration zone, subsequent to effecting the agglomeration of said admixture and inducement of hydration of the hydratable anhydrous components therein, an aqueous solution of said hardness sequestering agent whereby an agglomerated intermediate product containing the hardness sequestering agent is produced; and aging the agglomerated intermediate product at a temperature ranging from about 38° C. to about 48° C. whereby agglomerated, substantially completely hydrated detergent product is produced said detergent product being characterized by a degree of hydration ranging from about 70 percent to about 100 percent of the theoretical water of hydration for said detergent product.

2. The process of claim 1 where in the forming of the admixture, the alkali metal silicate and water are added in the form of an aqueous alkali metal silicate solution.

3. The process of claim 1 wherein the hydratable anhydrous condensed phosphate is sodium tripolyphosphate.

4. The process of claim 1 wherein the hydratable anhydrous detergent builder salt is sodium carbonate.

5. The process of claim 1 wherein the aqueous solution contains from about 50 to about 52 percent by weight of the hardness sequestering agent.

* * * * *